US009895283B1

(12) United States Patent
Gimblet

(10) Patent No.: US 9,895,283 B1
(45) Date of Patent: Feb. 20, 2018

(54) MOBILITY ASSISTANCE WALKER

(71) Applicant: Eugene Gimblet, Tampa, FL (US)

(72) Inventor: Eugene Gimblet, Tampa, FL (US)

( * ) Notice: Subject to any disclaimer, the term of this patent is extended or adjusted under 35 U.S.C. 154(b) by 0 days.

(21) Appl. No.: 15/431,884

(22) Filed: Feb. 14, 2017

(51) Int. Cl.
*A61H 3/04* (2006.01)

(52) U.S. Cl.
CPC ..... *A61H 3/04* (2013.01); *A61H 2201/0192* (2013.01); *A61H 2201/1633* (2013.01)

(58) Field of Classification Search
CPC ..... A61H 3/04; A61H 2201/1623; A61H 2201/1633; A61H 2201/0192; A61G 5/00; A61G 5/02; A61G 5/08
See application file for complete search history.

(56) References Cited

U.S. PATENT DOCUMENTS 4,342,465 A * 8/1982 Stillings ..... A61H 3/04 135/67
4,907,839 A 3/1990 Rose
5,277,438 A * 1/1994 Chuang ..... A61H 3/04 135/67
5,353,824 A 10/1994 Woods
5,443,304 A * 8/1995 Fochs ..... A61H 3/04 135/67
5,605,169 A 2/1997 Light
5,882,067 A 3/1999 Carbajal
5,904,168 A 5/1999 Alulyan
6,371,142 B1 4/2002 Battiston
D561,650 S 2/2008 Owens
8,573,612 B1 * 11/2013 Fulk ..... A61H 3/04 135/67
8,584,689 B2 11/2013 Catton
8,720,914 B1 5/2014 Heath
9,655,806 B2 * 5/2017 Naucke ..... A61G 5/10
2010/0263697 A1 * 10/2010 Catton ..... A61H 3/04 135/67
2014/0300071 A1 * 10/2014 Purdue ..... A61G 5/022 280/87.021
2017/0216127 A1 * 8/2017 Fulkerson ..... A61H 3/04 280/47.41

* cited by examiner

*Primary Examiner* — Brian L Swenson
(74) *Attorney, Agent, or Firm* — Kyle A. Fletcher, Esq.

(57) ABSTRACT

The mobility assistance walker is a wheeled structure. The selected person uses the mobility assistance walker for support while walking. The selected person rolls the mobility assistance walker along a horizontal surface in a manner that allows the selected person to walk with the support of the mobility assistance walker. The mobility assistance walker comprises an enclosable space and a chair. The chair is a structure upon which the selected person may sit. The chair is contained within the enclosable space. The mobility assistance walker comprises a plurality of side structures, a plurality of rear trusses, a gate, and a chair. The plurality of rear trusses, the gate, and the chair attach to the plurality of side structures.

15 Claims, 5 Drawing Sheets

MOBILITY ASSISTANCE WALKER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical or veterinary science including transport or accommodation for patients, more specifically, a chair and personal conveyance adapted for patients or disabled people.

SUMMARY OF INVENTION

The mobility assistance walker is a mobility assistant technology that is adapted for use with a person selected from the group consisting of a patient or a person with a disability. The mobility assistance walker is a wheeled structure. The selected person uses the mobility assistance walker for support while walking. The selected person rolls the mobility assistance walker along a horizontal surface in a manner that allows the selected person to walk with the support of the mobility assistance walker. The mobility assistance walker comprises an enclosable space and a chair. The chair is a structure upon which the selected person may sit. The chair is contained within the enclosable space. With the ability to enclose the selected person within the enclosable space while the selected person sits, the mobility assistance walker gives a caregiver assisting the selected person the opportunity to leave their charge for biological or administrative purposes. The mobility assistance walker comprises a plurality of side structures, a plurality of rear trusses, a gate, and a chair. The plurality of rear trusses, the gate, and the chair attach to the plurality of side structures.

These together with additional objects, features and advantages of the mobility assistance walker will be readily apparent to those of ordinary skill in the art upon reading the following detailed description of the presently preferred, but nonetheless illustrative, embodiments when taken in conjunction with the accompanying drawings.

In this respect, before explaining the current embodiments of the mobility assistance walker in detail, it is to be understood that the mobility assistance walker is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mobility assistance walker.

It is therefore important that the claims be regarded as including such equivalent construction insofar as they do not depart from the spirit and scope of the mobility assistance walker. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
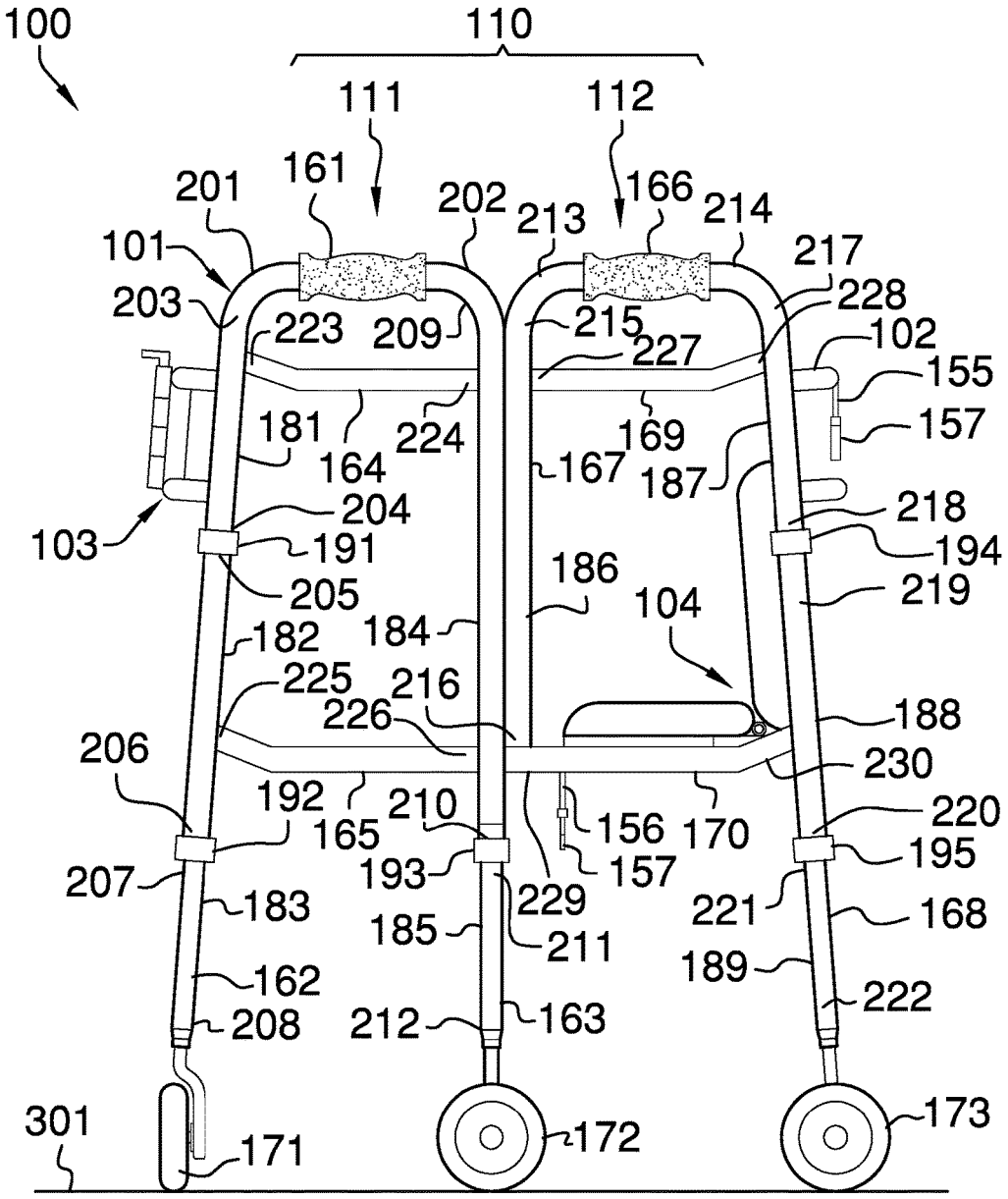
FIG. 1 is a side view of an embodiment of the disclosure.
Figure 2:
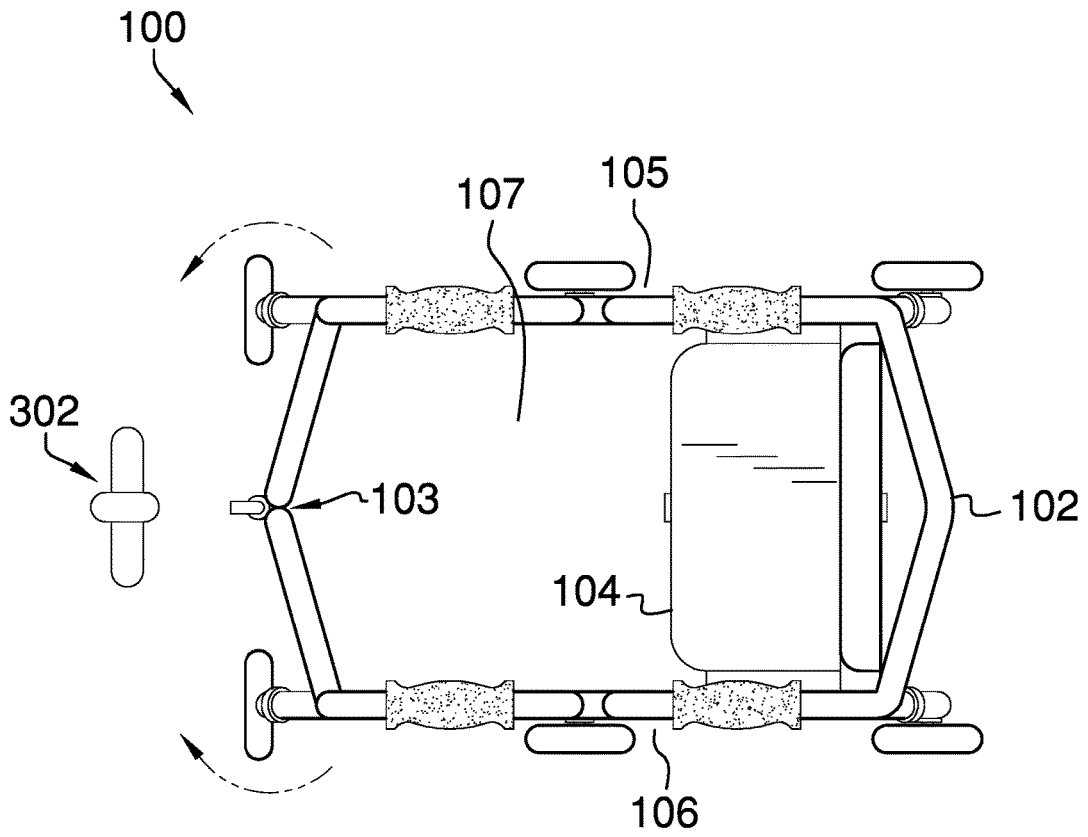
FIG. 2 is a top view of an embodiment of the disclosure.
Figure 3:
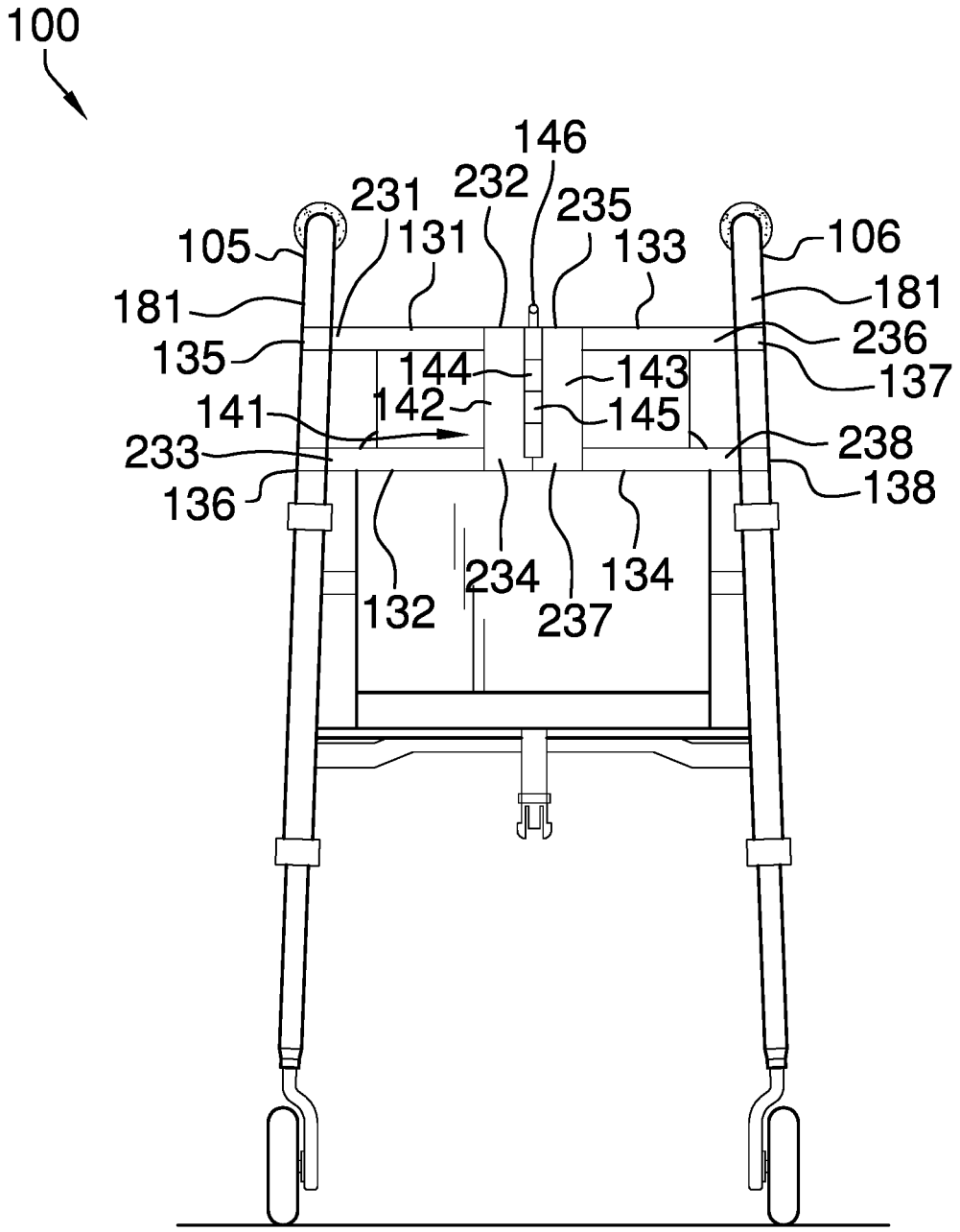
FIG. 3 is a front view of an embodiment of the disclosure.
Figure 4:
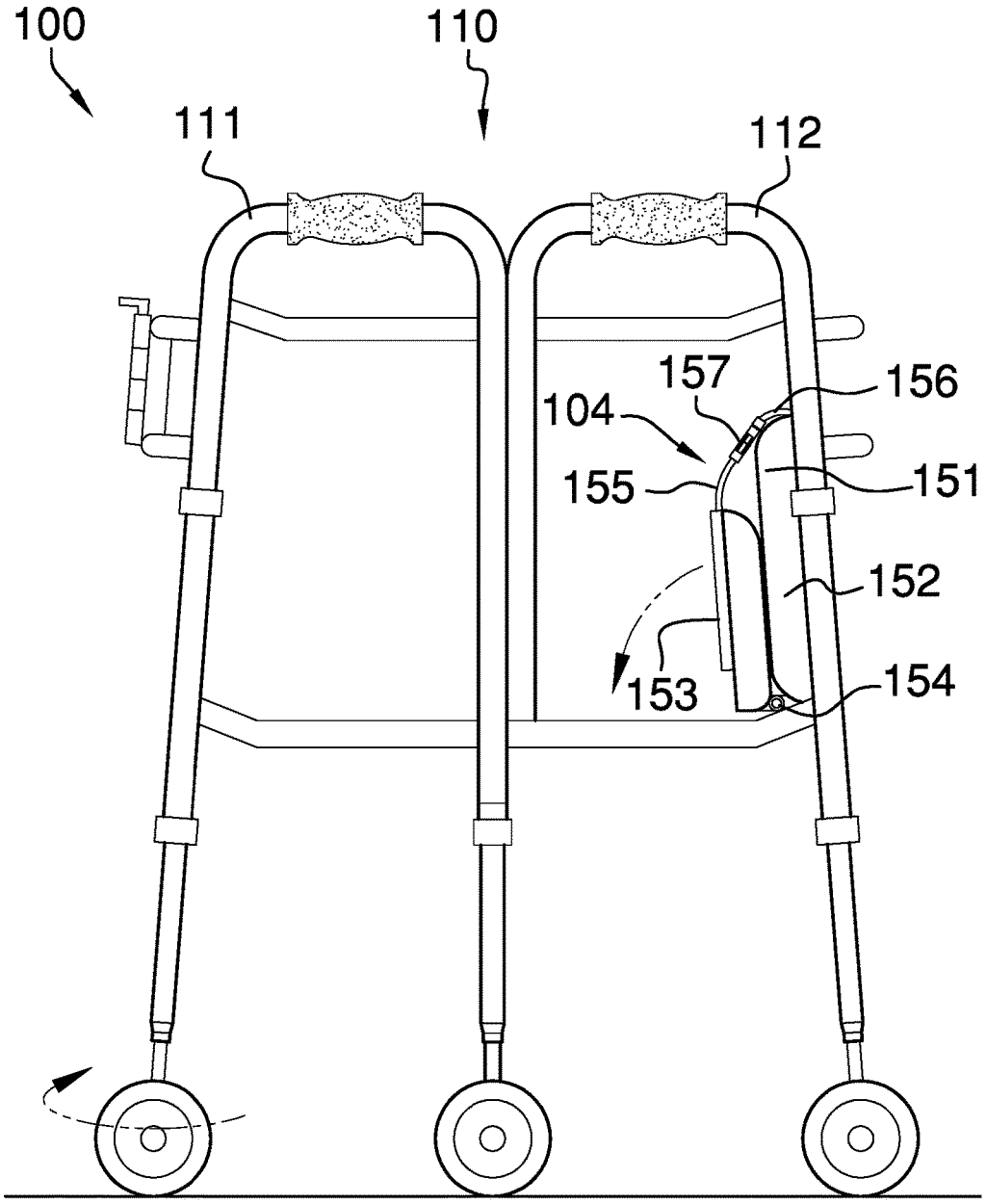
FIG. 4 is a detail view of an embodiment of the disclosure.
Figure 5:
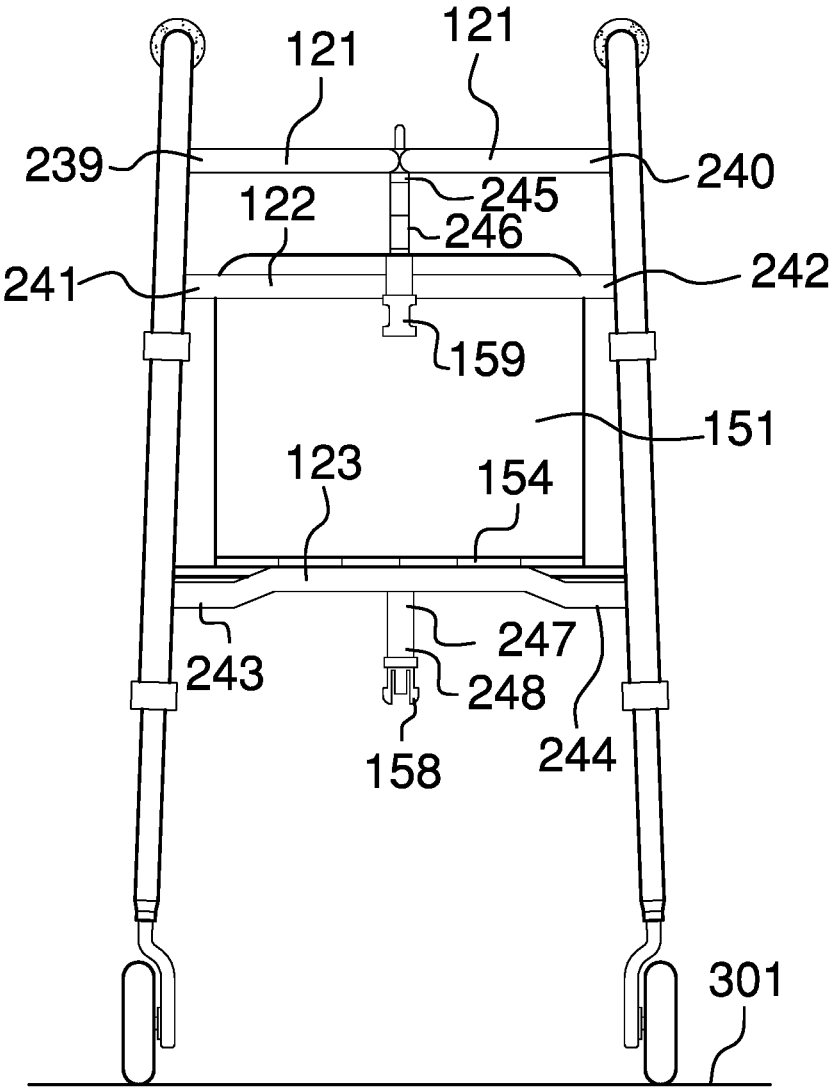
FIG. 5 is a rear view of an embodiment of the disclosure.

Detailed reference will now be made to one or more potential embodiments of the disclosure, which are illustrated in FIGS. 1 through 5.

The mobility assistance walker 100 (hereinafter invention) is a mobility assistant technology that is adapted for use with a person 302 selected from the group consisting of a patient or a person with a disability. The invention 100 is a wheeled structure. The selected person 302 uses the invention 100 for support while walking. The selected person 302 rolls the invention 100 along a horizontal surface 301 in a manner that allows the selected person 302 to walk with the support of the invention 100. The invention 100 comprises an enclosable space and a chair 104. The chair 104 is a structure upon which the selected person 302 may sit. The chair 104 is contained within the enclosable space 107. With the ability to enclose the selected person 302 within the enclosable space 107 while the selected person 302 sits, the invention 100 gives a caregiver assisting the selected person 302 the opportunity to leave their charge for biological or administrative purposes. The invention 100 comprises a plurality of side structures 101, a plurality of rear trusses 102, a gate 103, and a chair 104. The plurality of rear trusses 102, the gate 103, and the chair attach to the plurality of side structures 101. The invention 100 is further defined with the enclosable space 107. The enclosable space 107 is an interior space formed within boundaries delimited by the plurality of side structures 101, the plurality of rear trusses 102, and the gate 103. The enclosable space 107 is entered through the gate 103.

General note regarding the disclosure: unless otherwise specified within this disclosure, all attachments described in this disclosure are formed using one or more methods selected from the group consisting of welding, brazing, the use of plumbing fittings, or the use of commercially available hardware. Methods to make these attachments are well known and documented in the mechanical arts.

Each of the plurality of side structures 101 is a load bearing element of the invention 100. The plurality of side structures 101 provides the structure upon which the selected person 302 may support themselves. The plurality of side structures 101 comprises a plurality of individual side structures 110. The individual side structure 110 is a side structure selected from the plurality of side structures 101. Any first individual side structure 110 selected from the plurality of side structures 101 is identical to any second individual side structure 110 selected from the plurality of side structures 101. Each individual side structure 110 comprises a first telescopic pylon 111 and a second telescopic pylon 112.

The first telescopic pylon 111 is the structure of the individual side structure 110 that forms the front half of the individual side structure 110. The first telescopic pylon 111 is a telescopic structure of adjustable height. The second telescopic pylon 112 is the structure of the individual side structure 110 that forms the rear half of the individual side structure 110. The second telescopic pylon 112 is a telescopic structure of adjustable height. The first telescopic pylon 111 comprises a first handle 161, a first stanchion 162, a second stanchion 163, a first superior cross brace 164, a first inferior cross brace 165, a first caster 171, and a second caster 172. The second telescopic pylon 112 comprises a second handle 166, a third stanchion 167, a fourth stanchion 168, a second superior cross brace 169, a second inferior cross brace 170, and a third caster 173. The first telescopic pylon 111 is a U shaped structure wherein the first handle 161 forms the closed end of the U shape. The second telescopic pylon 112 is a U shaped structure wherein the second handle 166 forms the closed end of the U shape.

The first caster 171 is a readily and commercially available caster that rests upon the horizontal surface 301 during use of the invention 100. The second caster 172 is a readily and commercially available caster that rests upon the horizontal surface 301 during use of the invention 100. The third caster 173 is a readily and commercially available caster that rests upon the horizontal surface 301 during use of the invention 100.

The first superior cross brace 164 is a readily and commercially available shaft. The first inferior cross brace 165 is a readily and commercially available shaft. The second superior cross brace 169 is a readily and commercially available shaft. The second inferior cross brace 170 is a readily and commercially available shaft.

The first stanchion 162 is a first stanchion structure that raises the first handle 161 above the horizontal surface 301. The first handle 161 is a readily and commercially available shaft that forms the superior edge of the first telescopic pylon 111. The first stanchion 162 comprises a first arm 181, a second arm 182, a third arm 183, a first detent 191, and a second detent 192. The first arm 181 is a readily and commercially available pipe. The second arm 182 is a readily and commercially available pipe. The third arm 183 is a readily and commercially available pipe. The first detent 191 is a readily and commercially available mechanical device that telescopically attaches two pipes. The second detent 192 is a readily and commercially available mechanical device that telescopically attaches two pipes.

The second stanchion 163 is a second stanchion structure that raises the second handle 166 above the horizontal surface 301. The second handle 166 is a readily and commercially available shaft that forms the superior edge of the second telescopic pylon 112. The second stanchion 163 comprises a fourth arm 184, a fifth arm 185, and a third detent 193. The fourth arm 184 is a readily and commercially available pipe. The fifth arm 185 is a readily and commercially available pipe. The third detent 193 is a readily and commercially available mechanical device that telescopically attaches two pipes.

The third stanchion 167 is a third stanchion structure that raises the second handle 166 above the horizontal surface 301. The third stanchion 167 comprises a sixth arm 186. The sixth arm 186 is a readily and commercially available pipe.

The fourth stanchion 168 is a fourth stanchion structure that raises the second handle 166 above the horizontal surface 301. The fourth stanchion 168 comprises a seventh arm 187, an eighth arm 188, a ninth arm 189, a fourth detent 194, and a fifth detent 195. The seventh arm 187 is a readily and commercially available pipe. The eighth arm 188 is a readily and commercially available pipe. The ninth arm 189 is a readily and commercially available pipe. The fourth detent 194 is a readily and commercially available mechanical device that telescopically attaches two pipes. The fifth detent 195 is a readily and commercially available mechanical device that telescopically attaches two pipes.

The first handle 161 is further defined with a first end and a second end 202. The first arm 181 is further defined with a third end 203 and a fourth end 204. The second arm 182 is further defined with a fifth end 205 and a sixth end 206. The third arm 183 is further defined with a seventh end 207 and an eighth end 208. The fourth arm 184 is further defined with a ninth end 209 and a tenth end 210. The fifth arm 185 is further defined with an eleventh end 211 and a twelfth end 212. The first superior cross brace 164 is further defined with a twenty third end 223 and a twenty fourth end 224. The first inferior cross brace 165 is further defined with a twenty fifth end 225 and a twenty sixth end 226.

The second handle 166 is further defined with a thirteenth end 213 and a fourteenth end 214. The sixth arm 186 is further defined with a fifteenth end 215 and a sixteenth end 216. The seventh arm 187 is further defined with a seventeenth end 217 and an eighteenth end 218. The eighth arm 188 is further defined with a nineteenth end 219 and a twentieth end 220. The ninth arm 189 is further defined with a twenty first end 221 and a twenty second end 222. The second superior cross brace 169 is further defined with a twenty seventh end 227 and a twenty eighth end 228. The second inferior cross brace 170 is further defined with a twenty ninth end 229 and a thirtieth end 230.

The first arm 181 is further defined with an inner diameter and an outer diameter. The second arm 182 is further defined with an inner diameter and an outer diameter. The third arm 183 is further defined with an inner diameter and an outer diameter. The fourth arm 184 is further defined with an inner diameter and an outer diameter. The fifth arm 185 is further defined with an inner diameter and an outer diameter. The seventh arm 187 is further defined with an inner diameter and an outer diameter. The eighth arm 188 is further defined with an inner diameter and an outer diameter. The ninth arm 189 is further defined with an inner diameter and an outer diameter.

Each of the plurality of rear trusses 102 is a shaft that attaches a first side structure selected from the plurality of side structures 101 to a second side structure selected from the plurality of side structures 101 to form the rear side of the invention 100. The plurality of rear trusses 102 comprises a first rear truss 121, a second rear truss 122, and a third rear truss 123. The first rear truss 121 is a readily and commercially available shaft. The second rear truss 122 is a readily and commercially available shaft. The third rear truss 123 is a readily and commercially available shaft.

The gate 103 is a rotating barrier structure that forms the front side of the invention 100. The gate 103; 1) attaches a first side structure selected from the plurality of side structures 101 to a second side structure selected from the plurality of side structures 101; and, 2) provides access into and out of the enclosable space 107. The gate 103 comprises a left superior strut 131, a left inferior strut 132, a right superior strut 133, a right inferior strut 134, a left superior pivot 135, a left inferior pivot 136, a right superior pivot 137, a right inferior pivot 138, and a first hinge 141.

The left superior strut 131 is a readily and commercially available shaft. The left inferior strut 132 is a readily and commercially available shaft. The right superior strut 133 is a readily and commercially available shaft. The right inferior strut 134 is a readily and commercially available shaft. The left superior strut 131 is further defined with a thirty first end 231 and a thirty second end 232. The left inferior strut 132 is further defined with a thirty third end 233 and a thirty fourth end 234. The right superior strut 133 is further defined with a thirty fifth end 235 and a thirty sixth end 236. The right inferior strut 134 is further defined with a thirty seventh end 237 and a thirty eighth end 238.

The first hinge 141 is a readily and commercially available hinge. The first hinge 141 comprises a first leaf 142, a second leaf 143, a first knuckles 144, a second knuckles 145, and a pin 146. The first leaf 142 is the first of two plates of the first hinge 141 that is used to attach the first hinge 141 to a first object. The second leaf 143 is the second of two plates of the first hinge 141 that is used to attach the first hinge 141 to a second object. The first knuckles 144 comprises a first plurality of aligned hollow cylinders that are attached to the first leaf 142. The first knuckles 144 are sized and aligned to receive the pin 146. The second knuckles 145 comprises a second plurality of aligned hollow cylinders that are attached to the second leaf 143. The second knuckles 145 are sized and aligned to receive the pin 146. The pin 146 is a shaft that is inserted through the first knuckles 144 and the second knuckles 145 in order to assemble the first hinge 141.

The chair 104 is a structure that is formed within the enclosable space 107. The chair 104 provides a location for the selected person 302 to sit. The chair 104 comprises a backrest 151, a seat 152, a plank 153, a second hinge 154, a superior strap 155, an inferior strap 156, and a quick connect buckle 157.

The backrest 151 is a cushion that is mounted on the plurality of rear trusses 102. The backrest 151 supports the back of the selected person 302 while sitting. The seat 152 is a cushion that is mounted on the plank 153. The seat 152 provides a horizontal support upon which the selected person 302 sits. The plank 153 is a rectangular plate structure that supports the seat 152. The second hinge 154 is a readily and commercially available piano hinge. The superior strap 155 is a readily and commercially available textile webbing. The inferior strap 156 is a readily and commercially available textile webbing.

The quick connect buckle 157 is a readily and commercially available buckle type fastener. The quick connect buckle 157 comprises a male connector 158 and a female connector 159. The male connector 158 is a first connector associated with the quick connect buckle 157. The female connector 159 is a second connector associated with the quick connect buckle 157.

The first rear truss 121 is further defined with a thirty ninth end 239 and a fortieth end 240. The second rear truss 122 is further defined with a forty first end 241 and a forty second end 242. The third rear truss 123 is further defined with a forty third end 243 and a forty fourth end 244. The superior strap 155 is further defined with a forty fifth end 245 and a forty sixth end 246. The inferior strap 156 is further defined with a forty seventh end 247 and a forty eighth end 248.

The assembly of the invention 100 is described in the balance of this specification.

The first detent 191 secures the fifth end 205 of the second arm 182 to the fourth end 204 of the first arm 181. The outer dimension of the second arm 182 is less than the inner dimension of the first arm 181 such that the second arm 182 can be inserted into the first arm 181 in a telescopic manner. This telescopic arrangement of the first stanchion 162 allows the length of the first stanchion 162 to be adjusted by adjusting the relative position of the second arm 182 within the first arm 181. The position of the second arm 182 relative to the first arm 181 is held in position using the first detent 191. The first detent 191 is a mechanical device that connects and secures the first arm 181 to the second arm 182. The first detent 191 is selected from the group consisting of a cotter pin, a G snap collar, a cam lock collar, a threaded clutch, a split collar lock, or a spring loaded ball lock.

The second detent 192 secures the seventh end 207 of the third arm 183 to the sixth end 206 of the second arm 182. The outer dimension of the third arm 183 is less than the inner dimension of the second arm 182 such that the third arm 183 can be inserted into the second arm 182 in a telescopic manner. This telescopic arrangement of the first stanchion 162 allows the length of the first stanchion 162 to be adjusted by adjusting the relative position of the third arm 183 within the second arm 182. The position of the third arm 183 relative to the second arm 182 is held in position using the second detent 192. The second detent 192 is a mechanical device that connects and secures the second arm 182 to the third arm 183. The second detent 192 is selected from the group consisting of a cotter pin, a G snap collar, a cam lock collar, a threaded clutch, a split collar lock, or a spring loaded ball lock.

The third detent 193 secures the eleventh end 211 of the fifth arm 185 to the tenth end 210 of the fourth arm 184. The outer dimension of the fifth arm 185 is less than the inner dimension of the fourth arm 184 such that the fifth arm 185 can be inserted into the fourth arm 184 in a telescopic manner. This telescopic arrangement of the second stanchion 163 allows the length of the second stanchion 163 to be adjusted by adjusting the relative position of the fifth arm 185 within the fourth arm 184. The position of the fifth arm 185 relative to the fourth arm 184 is held in position using the third detent 193. The third detent 193 is a mechanical device that connects and secures the fourth arm 184 to the fifth arm 185. The third detent 193 is selected from the group consisting of a cotter pin, a G snap collar, a cam lock collar, a threaded clutch, a split collar lock, or a spring loaded ball lock.

The fourth detent 194 secures the nineteenth end 219 of the eighth arm 188 to the eighteenth end 218 of the seventh arm 187. The outer dimension of the eighth arm 188 is less than the inner dimension of the seventh arm 187 such that the eighth arm 188 can be inserted into the seventh arm 187 in a telescopic manner. This telescopic arrangement of the fourth stanchion 168 allows the length of the fourth stanchion 168 to be adjusted by adjusting the relative position of the eighth arm 188 within the seventh arm 187. The position of the eighth arm 188 relative to the seventh arm 187 is held in position using the fourth detent 194. The fourth detent 194 is a mechanical device that connects and secures the seventh arm 187 to the eighth arm 188. The fourth detent 194 is selected from the group consisting of a cotter pin, a G snap collar, a cam lock collar, a threaded clutch, a split collar lock, or a spring loaded ball lock.

The fifth detent 195 secures the twenty first end 221 of the ninth arm 189 to the twentieth end 220 of the eighth arm 188. The outer dimension of the ninth arm 189 is less than the inner dimension of the eighth arm 188 such that the ninth arm 189 can be inserted into the eighth arm 188 in a telescopic manner. This telescopic arrangement of the fourth stanchion 168 allows the length of the fourth stanchion 168 to be adjusted by adjusting the relative position of the ninth arm 189 within the eighth arm 188. The position of the ninth arm 189 relative to the eighth arm 188 is held in position using the fifth detent 195. The fifth detent 195 is a mechanical device that connects and secures the eighth arm 188 to the ninth arm 189. The fifth detent 195 is selected from the group consisting of a cotter pin, a G snap collar, a cam lock collar, a threaded clutch, a split collar lock, or a spring loaded ball lock.

The first end 201 of the first handle 161 attaches to the third end 203 of the first arm 181. The second end 202 of the first handle 161 attaches to the ninth end 209 of the fourth arm 184. The twenty third end 223 of the first superior cross brace 164 attaches to the face of the first arm 181. The twenty fourth end 224 of the first superior cross brace 164 attaches to the face of the fourth arm 184. The twenty fifth end 225 of the first inferior cross brace 165 attaches to the face of the second arm 182. The twenty sixth end 226 of the first inferior cross brace 165 attaches to the face of the fourth arm 184.

The thirteenth end 213 of the second handle 166 attaches to the fifteenth end 215 of the sixth arm 186. The fourteenth end 214 of the second handle 166 attaches to the seventeenth end 217 of the seventh arm 187. The twenty seventh end 227 of the second superior cross brace 169 attaches to the face of the sixth arm 186. The twenty eighth end 228 of the second superior cross brace 169 attaches to the face of the seventh arm 187. The twenty ninth end 229 of the second inferior cross brace 170 attaches to the face of the sixth arm 186. The twenty ninth end 229 of the second inferior cross brace 170 further attaches to the sixteenth end 216 of the sixth arm 186. The thirtieth end 230 of the second inferior cross brace 170 attaches to the face of the eighth arm 188.

The face of the sixth arm 186 of the third stanchion 167 attaches to the face of the fourth arm 184 of the second stanchion 163. The first caster 171 attaches to the eighth end 208 of the third arm 183 of the first stanchion 162. The second caster 172 attaches to the twelfth end 212 of the fifth arm 185 of the second stanchion 163. The third caster 173 attaches to the twenty second end 222 of the ninth arm 189 of the fourth stanchion 168.

The plurality of side structures 101 further comprises a left side support 105 and a right side support 106.

The left side support 105 is a side support that is selected from the plurality of side structures 101. The left side support 105 forms the left side of the invention 100 when the selected person 302 is facing the gate 103 from the exterior of the enclosable space 107. The right side support 106 is a side support that is selected from the plurality of side structures 101. The right side support 106 forms the right side of the invention 100 when the selected person 302 is facing the gate 103 from the exterior of the enclosable space 107.

The left superior pivot 135 is a commercially available rotating device that attaches the left superior strut 131 to the left side support 105 such that the left superior strut 131 will rotate around the left side support 105. The left inferior pivot 136 is a commercially available rotating device that attaches the left inferior strut 132 to the left side support 105 such that the left inferior strut 132 will rotate around the left side support 105. The right superior pivot 137 is a commercially available rotating device that attaches the right superior strut 133 to the right side support 106 such that the right superior strut 133 will rotate around the right side support 106. The right inferior pivot 138 is a commercially available rotating device that attaches the right inferior strut 134 to the right side support 106 such that the right inferior strut 134 will rotate around the right side support 106.

The left superior pivot 135 attaches the thirty first end 231 of the left superior strut 131 to the first arm 181 of the left side support 105. The left inferior pivot 136 attaches the thirty third end 233 of the left inferior strut 132 to the first arm 181 of the left side support 105. The right superior pivot 137 attaches the thirty sixth end 236 of the right superior strut 133 to the first arm 181 of the right side support 106. The right inferior pivot 138 attaches the thirty eighth end 238 of the right inferior strut 134 to the first arm 181 of the right side support 106.

The thirty second end 232 of the left superior strut 131 attaches to the first leaf 142 of the first hinge 141. The thirty fourth end 234 of the left inferior strut 132 attaches to the first leaf 142 of the first hinge 141. The thirty fifth end 235 of the right superior strut 133 attaches to the second leaf 143 of the first hinge 141. The thirty seventh end 237 of the right inferior strut 134 attaches to the second leaf 143 of the first hinge 141.

The first knuckles 144 attaches to the first leaf 142 and the second knuckles 145 attaches to the second leaf 143 such that the first knuckles 144 and the second knuckles 145 will interleaf. The first knuckles 144 and the second knuckles 145 interleaf in such a manner that the pin 146 is inserted through the first knuckles 144 and the second knuckles 145. The insertion of the pin 146 through the first knuckles 144 and the second knuckles 145 secures the first leaf 142 to the second leaf 143 to form the first hinge 141.

The thirty ninth end 239 of the first rear truss 121 attaches to the face of the seventh arm 187 of the right side support 106. The fortieth end 240 of the first rear truss 121 attaches to the face of the seventh arm 187 of the left side support 105. The forty first end 241 of the second rear truss 122 attaches to the face of the seventh arm 187 of the right side support 106. The forty second end 242 of the second rear truss 122 attaches to the face of the seventh arm 187 of the left side support 105. The forty third end 243 of the third rear truss 123 attaches to the face of the eighth arm 188 of the right side support 106. The forty fourth end 244 of the third rear truss 123 attaches to the face of the eighth arm 188 of the left side support 105.

The forty fifth end 245 of the superior strap 155 attaches to the first rear truss 121 using a sewn seam. The forty seventh end 247 of the inferior strap 156 attaches to the seat 152 using a sewn seam. The female connector 159 of the quick connect buckle 157 attaches to the forty sixth end 246 of the superior strap 155. The male connector 158 of the quick connect buckle 157 attaches to the forty eighth end 248 of the inferior strap 156.

The span of the plank 153 is greater than the span of the distance between the second inferior cross brace 170 of the left side support 105 and the second inferior cross brace 170 of the right side support 106 such that the plank 153 can be attached to and supported by the second inferior cross brace 170 of the left side support 105 and the second inferior cross brace 170 of the right side support 106. The second hinge 154 attaches the seat 152 to the superior surface of the plank 153 such that the seat 152 will rotate away from the plank 153 towards the backrest 151. The seat 152 is secured in the upright position using the quick connect buckle 157. Methods to use buckles to secure objects are well known and documented in the mechanical and textile arts.

The following definitions were used in this disclosure:

Align: As used in this disclosure, align refers to an arrangement of objects that are: 1) arranged in a straight line; or, 2) arranged to give a directional sense of a plurality of parallel lines.

Buckle: As used in this disclosure, a buckle is a fastening that is used for joining a first loose end of a strap to a second loose end of the same strap or a different strap. A buckle further comprises a male connector that is attached to a first loose end and a female connector that is attached to a second loose end. The male connector has a pin or other structure that is generally caught by a structure formed in the female connector.

Caster: As used in this disclosure, a caster is a wheel that is mounted on a swivel that allows the wheel to adjust, or swivel, the direction of rotation of the wheel to the direction of motion desired for the wheel.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Center of Rotation: As used in this disclosure, the center of rotation is the point of a rotating plane that does not move with the rotation of the plane. A line within a rotating three dimensional object that does not move with the rotation of the object is referred to as an axis of rotation.

Cushion: As used in this disclosure a cushion is a pad or pillow formed from soft material that is used for resting, sleeping, or reclining.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Detent: As used in this disclosure, a detent is a device for positioning and holding one mechanical part in relation to another in a manner such that the device can be released by force applied to one or more of the parts.

Fastener: As used in this disclosure, a fastener is a device that is used to join or affix two objects. Fasteners generally comprise a first element which is attached to the first object and a second element which is attached to the second object such that the first element and the second element join to affix the first object and the second object. Common fasteners include, but are not limited to, zippers, snaps, buttons, buckles, quick release buckles, or hook and loop fasteners.

Hinge: As used in this disclosure, a hinge is a device that permits the turning, rotating, or pivoting of a first object relative to a second object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Pad: As used in this disclosure, a pad is a mass of soft material used as a filling or for protection against damage or injury. Commonly used padding materials include, but are not limited to, polyurethane foam, a polyester fill often referred to as fiberfill or polystyrene beads often referred to as stuffing beans or as bean bag chair beans.

Piano Hinge: As used in this disclosure, a piano hinge is: 1) a hinge that is longer than 12 inches; and 2) has a pin that runs fully along at least one of the surfaces that the piano hinge is attached to. Piano hinges are also commonly referred to as continuous hinges.

Pipe: As used in this disclosure, the term pipe is used to describe a rigid hollow cylinder. While pipes that are suitable for use in this disclosure are often used to transport or conveys fluids or gases, the purpose of the pipes in this disclosure are structural. In this disclosure, the terms inner diameter of a pipe and outer diameter are used as they would be used by those skilled in the plumbing arts.

Pivot: As used in this disclosure, a pivot is a rod or shaft around which an object rotates or swings.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Quick Release Buckle: As used in this disclosure, a quick release buckle is a specific type of buckle wherein the buckle can be readily and easily disconnected by pressing a button or pinching one of the ends of the quick release buckle. Quick release buckles are readily and commercially available.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Stanchion: As used in this disclosure, a stanchion refers to an upright pole, post, or support.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Superior: As used in this disclosure, the term superior refers to a directional reference that is parallel to and in the opposite direction of the force of gravity.

Telescopic: As used in this disclosure, telescopic is an adjective that describes an object made of sections that fit or slide into each other such that the object can be made longer or shorter by adjusting the relative positions of the sections.

Textile: As used in this disclosure, a textile is a material that is woven, knitted, braided or felted. Synonyms in common usage for this definition include fabric and cloth.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mobility assistance device comprising:

wherein the mobility assistance device comprises a plurality of side structures, a plurality of rear trusses, a gate, and a chair;

wherein the plurality of rear trusses, the gate, and the chair attach to the plurality of side structures;

wherein the mobility assistance device is further defined with an enclosable space;

wherein the enclosable space is an interior space formed within boundaries delimited by the plurality of side structures, the plurality of rear trusses, and the gate;

wherein the mobility assistance device is adapted for use with a person selected from the group consisting of a patient or a person with a disability;

wherein the mobility assistance device is a wheeled structure;

wherein the selected person rolls the mobility assistance device along a horizontal surface in a manner that allows the selected person to walk with the support of the mobility assistance device;

wherein the mobility assistance device comprises a chair;

wherein the chair is contained within the enclosable space;

wherein the enclosable space is entered through the gate;

wherein each of the plurality of rear trusses attaches a first side structure selected from the plurality of side structures to a second side structure selected from the plurality of side structures to form the rear side of the mobility assistance device;

wherein the plurality of rear trusses forms the rear side of the mobility assistance device;

wherein the gate is a rotating barrier structure that forms the front side of the mobility assistance device;

wherein the gate attaches a first side structure selected from the plurality of side structures to a second side structure selected from the plurality of side structures;

wherein the gate provides access into and out of the enclosable space;

wherein the chair is a structure that is formed within the enclosable space;

wherein the chair provides a location for the selected person to sit;

wherein the plurality of side structures comprises a collection of individual side structures;

wherein the individual side structure is a side structure selected from the plurality of side structures;

wherein any first individual side structure selected from the plurality of side structures is identical to any second individual side structure selected from the plurality of side structures;

wherein each individual side structure comprises a first telescopic pylon and a second telescopic pylon;

wherein the first telescopic pylon is the structure of the individual side structure that forms the front half of the individual side structure;

wherein the first telescopic pylon is a telescopic structure of adjustable height;

wherein the second telescopic pylon is the structure of the individual side structure that forms the rear half of the individual side structure;

wherein the second telescopic pylon is a telescopic structure of adjustable height.

2. The mobility assistance device according to claim 1 wherein the first telescopic pylon comprises a first handle, a first stanchion, a second stanchion, a first superior cross brace, a first inferior cross brace, a first caster, and a second caster;

wherein the first handle, the first superior cross brace and the first inferior cross brace attach the first stanchion to the second stanchion;

wherein the first handle is shaft that forms the superior edge of the first telescopic pylon;

wherein the second handle is shaft that forms the superior edge of the second telescopic pylon;

wherein the first caster attaches to the first stanchion;

wherein the second caster attaches to the second stanchion;

wherein the second telescopic pylon comprises a second handle, a third stanchion, a fourth stanchion, a second superior cross brace, a second inferior cross brace, and a third caster;

wherein the second handle, the second superior cross brace, and the second inferior cross brace attach the third stanchion to the fourth stanchion;

wherein the third caster attaches to the fourth stanchion;

wherein the first telescopic pylon is a U shaped structure wherein the first handle forms the closed end of the U shape;

wherein the second telescopic pylon is a U shaped structure wherein the second handle forms the closed end of the U shape;

wherein the first handle is further defined with a first end and a second end;

wherein the second handle is further defined with a third end and a fourth end.

3. The mobility assistance device according to claim 2 wherein the first caster rests upon the horizontal surface;

wherein the second caster rests upon the horizontal surface during use of the mobility assistance device;

wherein the third caster that rests upon the horizontal surface during use of the mobility assistance device;

wherein the first superior cross brace is shaft;

wherein the first inferior cross brace is shaft;

wherein the second superior cross brace shaft;

wherein the second inferior cross brace is shaft;

wherein the first superior cross brace is further defined with a fifth end and a sixth end;

wherein the first inferior cross brace is further defined with a seventh end and an eighth end;

wherein the second superior cross brace is further defined with a ninth end and a tenth end;

wherein the second inferior cross brace is further defined with an eleventh end and a twelfth end.

4. The mobility assistance device according to claim 3 wherein the first stanchion is a first structure that raises the first handle above the horizontal surface;

wherein the first stanchion comprises a first arm, a second arm, a third arm, a first detent, and a second detent;

wherein the first detent attaches the second arm to the first arm;

wherein the second detent attaches the third arm to the second arm;

wherein the first arm is a pipe;

wherein the second arm is a pipe;

wherein the third arm is a pipe;

wherein the first detent is mechanical device that telescopically attaches two pipes;

wherein the second detent is a mechanical device that telescopically attaches two pipes;

wherein the first arm is further defined with a thirteenth end and a fourteenth end;

wherein the second arm is further defined with a fifteenth end and a sixteenth end;

wherein the third arm is further defined with a seventeenth end and an eighteenth end;

wherein the first arm is further defined with an inner diameter and an outer diameter;

wherein the second arm is further defined with an inner diameter and an outer diameter;

wherein the third arm is further defined with an inner diameter and an outer diameter.

5. The mobility assistance device according to claim 4 wherein the second stanchion is a second structure that raises the first handle above the horizontal surface;

wherein the second stanchion comprises a fourth arm, a fifth arm, and a third detent;

wherein the third detent attaches the fifth arm to the fourth arm;

wherein the fourth arm is a pipe;

wherein the fifth arm is a pipe;

wherein the third detent is a mechanical device that telescopically attaches two pipes;

wherein the fourth arm is further defined with a nineteenth end and a twentieth end;

wherein the fifth arm is further defined with a twenty first end and a twenty second end;

wherein the fourth arm is further defined with an inner diameter and an outer diameter;

wherein the fifth arm is further defined with an inner diameter and an outer diameter.

6. The mobility assistance device according to claim 5 wherein the third stanchion is a third structure that raises the second handle above the horizontal surface;

wherein the third stanchion comprises a sixth arm;

wherein the sixth arm is a pipe;

wherein the sixth arm is further defined with a twenty third end and a twenty fourth end.

7. The mobility assistance device according to claim 6 wherein the fourth stanchion is a fourth structure that raises the second handle above the horizontal surface;

wherein the fourth stanchion comprises a seventh arm, an eighth arm, a ninth arm, a fourth detent, and a fifth detent;

wherein the fourth detent attaches the eighth arm to the seventh arm;

wherein the fifth detent ninth arm to the eighth arm;

wherein the seventh arm is a pipe;

wherein the eighth arm is a pipe;

wherein the ninth arm is a pipe;

wherein the fourth detent is a mechanical device that telescopically attaches two pipes;

wherein the fifth detent is a mechanical device that telescopically attaches two pipes;

wherein the seventh arm is further defined with a twenty fifth end and a twenty sixth end;

wherein the eighth arm is further defined with a twenty seventh end and a twenty eighth end;

wherein the ninth arm is further defined with a twenty ninth end and a thirtieth end;

wherein the seventh arm is further defined with an inner diameter and an outer diameter;

wherein the eighth arm is further defined with an inner diameter and an outer diameter;

wherein the ninth arm is further defined with an inner diameter and an outer diameter.

8. The mobility assistance device according to claim 7 wherein the plurality of rear trusses comprises a first rear truss, a second rear truss, and a third rear truss;

wherein the first rear truss is a shaft;

wherein the second rear truss is a shaft;

wherein the third rear truss is a shaft;

wherein the first rear truss is further defined with a thirty first end and a thirty second end;

wherein the second rear truss is further defined with a thirty third end and a thirty fourth end;

wherein the third rear truss is further defined with a thirty fifth end and a thirty sixth end.

9. The mobility assistance device according to claim 8 wherein the gate comprises a left superior strut, a left inferior strut, a right superior strut, a right inferior strut, a left superior pivot, a left inferior pivot, a right superior pivot, a right inferior pivot, and a first hinge;

wherein the left superior strut, the left inferior strut, the right superior strut, the right inferior strut attach to the first hinge;

wherein the left superior pivot attaches the left superior strut to the first selected side structure, wherein the left inferior pivot attaches the left inferior strut to the first selected side structure, wherein the right superior pivot attaches the left superior strut to the second selected side structure, wherein the right inferior pivot attaches the left inferior strut to the second selected side structure, wherein the left superior strut is a shaft;

wherein the left inferior strut is a shaft;

wherein the right superior strut is a shaft;

wherein the right inferior strut is a shaft;

wherein the left superior pivot is a rotating device;

wherein the left inferior pivot is a rotating device;

wherein the right superior pivot is a rotating device;

wherein the right inferior pivot is a rotating device;

wherein the left superior strut is further defined with a thirty seventh end and a thirty eighth end;

wherein the left inferior strut is further defined with a thirty ninth end and a fortieth end;

wherein the right superior strut is further defined with a forty first end and a forty second end;

wherein the right inferior strut is further defined with a forty third end and a forty fourth end.

10. The mobility assistance device according to claim 9 wherein the first hinge comprises a first leaf, a second leaf, a first knuckles, a second knuckles, and a pin;

wherein the first leaf is the first of two plates;

wherein the second leaf is the second of two plates;

wherein the first knuckles comprises a first plurality of aligned hollow cylinders that are attached to the first leaf;

wherein the second knuckles comprises a second plurality of aligned hollow cylinders that are attached to the second leaf;

wherein the first knuckles are sized and aligned to receive the pin;

wherein the second knuckles are sized and aligned to receive the pin;

wherein the pin is a shaft that is inserted through the first knuckles and the second knuckles.

11. The mobility assistance device according to claim 10 wherein the chair comprises a backrest, a seat, a plank, a second hinge, a superior strap, an inferior strap, and a quick connect buckle;

wherein the backrest is a cushion that is mounted on the plurality of rear trusses;

wherein the seat is a cushion that is mounted on the plank;

wherein the plank is a rectangular plate structure that supports the seat;

wherein the second hinge is a piano hinge;

wherein the superior strap is a first textile webbing;

wherein the inferior strap is a second textile webbing;

wherein the quick connect buckle is a fastener;

wherein the quick connect buckle comprises a male connector and a female connector;

wherein the superior strap is further defined with a forty fifth end and a forty sixth end;

wherein the inferior strap is further defined with a forty seventh end and a forty eighth end.

12. The mobility assistance device according to claim 11 wherein the first detent secures the fifteenth end of the second arm to the fourteenth end of the first arm;

wherein the outer dimension of the second arm is less than the inner dimension of the first arm such that the second arm can be inserted into the first arm in a telescopic manner;

wherein this telescopic arrangement of the first stanchion allows the length of the first stanchion to be adjusted by adjusting the relative position of the second arm within the first arm;

wherein the position of the second arm relative to the first arm is held in position using the first detent;

wherein the first detent is selected from the group consisting of a cotter pin, a g snap collar, a cam lock collar, a threaded clutch, a split collar lock, or a spring loaded ball lock;

wherein the second detent secures the seventeenth end of the third arm to the sixteenth end of the second arm;

wherein the outer dimension of the third arm is less than the inner dimension of the second arm such that the third arm can be inserted into the second arm in a telescopic manner;

wherein this telescopic arrangement of the first stanchion allows the length of the first stanchion to be adjusted by adjusting the relative position of the third arm within the second arm;

wherein the position of the third arm relative to the second arm is held in position using the second detent;

wherein the second detent is selected from the group consisting of a cotter pin, a g snap collar, a cam lock collar, a threaded clutch, a split collar lock, or a spring loaded ball lock;

wherein the third detent secures the twenty first end of the fifth arm to the twentieth end of the fourth arm;

wherein the outer dimension of the fifth arm is less than the inner dimension of the fourth arm such that the fifth arm can be inserted into the fourth arm in a telescopic manner;

wherein this telescopic arrangement of the second stanchion allows the length of the second stanchion to be adjusted by adjusting the relative position of the fifth arm within the fourth arm;

wherein the position of the fifth arm relative to the fourth arm is held in position using the third detent;

wherein the third detent is selected from the group consisting of a cotter pin, a g snap collar, a cam lock collar, a threaded clutch, a split collar lock, or a spring loaded ball lock.

13. The mobility assistance device according to claim 12 wherein the fourth detent secures the twenty seventh end of the eighth arm to the twenty sixth end of the seventh arm;

wherein the outer dimension of the eighth arm is less than the inner dimension of the seventh arm such that the eighth arm can be inserted into the seventh arm in a telescopic manner;

wherein this telescopic arrangement of the fourth stanchion allows the length of the fourth stanchion to be adjusted by adjusting the relative position of the eighth arm within the seventh arm;

wherein the position of the eighth arm relative to the seventh arm is held in position using the fourth detent;

wherein the fourth detent is selected from the group consisting of a cotter pin, a g snap collar, a cam lock collar, a threaded clutch, a split collar lock, or a spring loaded ball lock;

wherein the fifth detent secures the twenty ninth end of the ninth arm to the twenty eighth end of the eighth arm;

wherein the outer dimension of the ninth arm is less than the inner dimension of the eighth arm such that the ninth arm can be inserted into the eighth arm in a telescopic manner;

wherein this telescopic arrangement of the fourth stanchion allows the length of the fourth stanchion to be adjusted by adjusting the relative position of the ninth arm within the eighth arm;

wherein the position of the ninth arm relative to the eighth arm is held in position using the fifth detent;

wherein the fifth detent is selected from the group consisting of a cotter pin, a g snap collar, a cam lock collar, a threaded clutch, a split collar lock, or a spring loaded ball lock.

14. The mobility assistance device according to claim 13 wherein the first end of the first handle attaches to the thirteenth end of the first arm;

wherein the second end of the first handle attaches to the nineteenth end of the fourth arm;

wherein the fifth end of the first superior cross brace attaches to the face of the first arm;

wherein the sixth end of the first superior cross brace attaches to the face of the fourth arm;

wherein the seventh end of the first inferior cross brace attaches to the face of the second arm;

wherein the eighth end of the first inferior cross brace attaches to the face of the fourth arm;

wherein the third end of the second handle attaches to the twenty third end of the sixth arm;

wherein the fourth end of the second handle attaches to the twenty fifth end of the seventh arm;

wherein the seventh end of the second superior cross brace attaches to the face of the sixth arm;

wherein the tenth end of the second superior cross brace attaches to the face of the seventh arm;

wherein the eleventh end of the second inferior cross brace attaches to the face of the sixth arm;

wherein the eleventh end of the second inferior cross brace further attaches to the twenty fourth end of the sixth arm;

wherein the twelfth end of the second inferior cross brace attaches to the face of the eighth arm.

15. The mobility assistance device according to claim 14 wherein the face of the sixth arm of the third stanchion attaches to the face of the fourth arm of the second stanchion;

wherein the first caster attaches to the eighteenth end of the third arm of the first stanchion;

wherein the second caster attaches to the twenty second end of the fifth arm of the second stanchion;

wherein the third caster attaches to the thirtieth end of the ninth arm of the fourth stanchion;

wherein the plurality of side structures further comprises a left side support and a right side support;

wherein the left side support is a side support that is selected from the plurality of side structures;

wherein the left side support forms the left side of the mobility assistance device when the selected person is facing the gate from the exterior of the enclosable space;

wherein the right side support is a side support that is selected from the plurality of side structures;

wherein the right side support forms the right side of the mobility assistance device when the selected person is facing the gate from the exterior of the enclosable space;

wherein the left superior pivot attaches the left superior strut to the left side support such that the left superior strut will rotate around the left side support;

wherein the left inferior pivot attaches the left inferior strut to the left side support such that the left inferior strut will rotate around the left side support;

wherein the right superior pivot attaches the right superior strut to the right side support such that the right superior strut will rotate around the right side support;

wherein the right inferior pivot attaches the right inferior strut to the right side support such that the right inferior strut will rotate around the right side support;

wherein the left superior pivot attaches the thirty seventh end of the left superior strut to the first arm of the left side support;

wherein the left inferior pivot attaches the thirty ninth end of the left inferior strut to the first arm of the left side support;

wherein the right superior pivot attaches the forty second end of the right superior strut to the first arm of the right side support;

wherein the right inferior pivot attaches the forty fourth end of the right inferior strut to the first arm of the right side support;

wherein the thirty eighth end of the left superior strut attaches to the first leaf of the first hinge;

wherein the fortieth end of the left inferior strut attaches to the first leaf of the first hinge;

wherein the forty first end of the right superior strut attaches to the second leaf of the first hinge;

wherein the forty third end of the right inferior strut attaches to the second leaf of the first hinge;

wherein the first knuckles attaches to the first leaf and the second knuckles attaches to the second leaf such that the first knuckles and the second knuckles will interleaf;

wherein the first knuckles and the second knuckles interleaf in such a manner that the pin is inserted through the first knuckles and the second knuckles;

wherein the insertion of the pin through the first knuckles and the second knuckles secures the first leaf to the second leaf to form the first hinge;

wherein the thirty first end of the first rear truss attaches to the face of the seventh arm of the right side support;

wherein the thirty second end of the first rear truss attaches to the face of the seventh arm of the left side support;

wherein the thirty third end of the second rear truss attaches to the face of the seventh arm of the right side support;

wherein the thirty fourth end of the second rear truss attaches to the face of the seventh arm of the left side support;

wherein the thirty fifth end of the third rear truss attaches to the face of the eighth arm of the right side support;

wherein the thirty sixth end of the third rear truss attaches to the face of the eighth arm of the left side support;

wherein the forty fifth end of the superior strap attaches to the first rear truss using a sewn seam;

wherein the forty seventh end of the inferior strap attaches to the seat using a sewn seam;

wherein the female connector of the quick connect buckle attaches to the forty sixth end of the superior strap;

wherein the male connector of the quick connect buckle attaches to the forty eighth end of the inferior strap;

wherein the span of the plank is greater than the span of the distance between the second inferior cross brace of the left side support and the second inferior cross brace of the right side support such that the plank attaches to the second inferior cross brace of the left side support and the second inferior cross brace of the right side support;

wherein the second hinge attaches the seat to the superior surface of the plank such that the seat will rotate away from the plank towards the backrest;

wherein the seat is secured in an upright position using the quick connect buckle.

* * * * *